US007891368B2

(12) United States Patent
Tison et al.

(10) Patent No.: US 7,891,368 B2
(45) Date of Patent: Feb. 22, 2011

(54) COMBINATION COLLAPSIBLE UMBRELLA AND TOWEL

(76) Inventors: Barae Tison, 9 Parkside Way, Greenbrae, CA (US) 94904; Thomas J. Tison, 9 Parkside Way, Greenbrae, CA (US) 94904

( * ) Notice: Subject to any disclaimer, the term of this patent is extended or adjusted under 35 U.S.C. 154(b) by 182 days.

(21) Appl. No.: 12/253,031

(22) Filed: Oct. 16, 2008

(65) Prior Publication Data

US 2010/0095990 A1 Apr. 22, 2010

(51) Int. Cl.
*A45B 19/00* (2006.01)
*A45B 15/00* (2006.01)

(52) U.S. Cl. ..... 135/33.2; 135/16; 5/417

(58) Field of Classification Search ..... 135/15.1, 135/16, 19.5, 33.2–33.41, 115, 119; 5/417–419
See application file for complete search history.

(56) References Cited

U.S. PATENT DOCUMENTS

| | | | | | |
|---|---|---|---|---|---|
| 2,455,288 | A * | 11/1948 | Alvarez | 135/19.5 |
| 4,061,154 | A * | 12/1977 | Cox et al. | 135/33.41 |
| 5,207,508 | A * | 5/1993 | Koutsis, Jr. | 383/4 |
| 5,339,847 | A * | 8/1994 | Kanter et al. | 135/16 |
| 5,390,685 | A * | 2/1995 | McCoy | 135/19 |
| 5,482,374 | A * | 1/1996 | Buhyoff | 383/4 |
| 5,899,571 | A * | 5/1999 | Chalk | 383/4 |
| 6,083,114 | A * | 7/2000 | Bailey | 473/196 |
| 6,243,873 | B1 * | 6/2001 | Aliff | 2/88 |
| 6,502,257 | B1 * | 1/2003 | Glenn | 5/418 |
| 2004/0020522 | A1 * | 2/2004 | James | 135/16 |
| 2007/0006908 | A1 * | 1/2007 | Arlis | 135/98 |
| 2007/0125409 | A1 * | 6/2007 | Cullen | 135/33.41 |
| 2007/0256717 | A1 * | 11/2007 | Stollar | 135/33.2 |
| 2008/0302401 | A1 * | 12/2008 | Pettitt | 135/16 |
| 2010/0022149 | A1 * | 1/2010 | Austin | 442/239 |

FOREIGN PATENT DOCUMENTS

| | | |
|---|---|---|
| JP | 09-149809 | 6/1997 |
| JP | 11-113615 | 4/1999 |
| KR | 20-0311907 | 5/2003 |
| KR | 10-2005-0079757 | 8/2005 |

* cited by examiner

*Primary Examiner*—Winnie Yip
(74) *Attorney, Agent, or Firm*—Raubvogel Law Office

(57) ABSTRACT

A collapsible umbrella has an open position and a collapsed position. In a collapsed position, the umbrella of the present invention can be used as a towel, to clean, wipe, and or dry objects, hands, faces, and the like. In an open position, the umbrella function is enabled, so as to protect a person or objects from rain and/or sun. In one embodiment, the canopy of the umbrella is constructed from material having two surfaces performing different functions. In one embodiment, the umbrella of the present invention contains a mechanism adapted to collapse the umbrella in a manner that turns the canopy inside out when in the collapsed position, so as to hide the water-resistant surface of the canopy and expose the absorbent surface. The absorbent surface then becomes naturally accessible for use when the umbrella is in the collapsed position.

16 Claims, 14 Drawing Sheets

COMBINATION COLLAPSIBLE UMBRELLA AND TOWEL

BACKGROUND OF THE INVENTION

1. Field of the Invention

The present invention relates to a collapsible umbrella, and more particularly, to an umbrella that is usable as a towel when in its collapsed position.

2. Description of the Related Art

It is often difficult to predict when an umbrella may be needed to shield oneself (and/or one's possessions) from rain or sun. Golfers in particular are susceptible to being caught in the rain; in such situations, it may be useful to have an umbrella to shield oneself and/or one's clubs. Moisture on the grip of a club can adversely affect performance; accordingly, golfers try hard to protect their clubs from rain.

The Club Umbrella, available from The Club Umbrella of Oakville, Ontario, Canada, and described at www.theclubumbrella.com, is a miniature umbrella that clamps onto the side of a golf bag and protects clubs from rain. Clubs can be removed from the bag by bending the umbrella stem so that the canopy moves out of the way, allowing access to the clubs.

A disadvantage of existing umbrellas, including golf-club umbrellas such as The Club Umbrella, is that they are relatively bulky. Even collapsible umbrellas have a weight and a bulk that can be awkward to carry at all times. When there is no need for protection from sun or rain, umbrellas have no useful purpose. In particular, an umbrella in its collapsed position has no utility. Because of their bulk, and because they are only useful in certain situations, most people do not carry umbrellas with them at all times. As a result, a golfer caught in an unexpected rainstorm without an umbrella may attempt to cover his or her clubs with whatever is at hand (towels, rags, jackets), but such attempts are often inadequate.

Golfers and other individuals also find it useful to carry a towel, for example to clean or dry off golf clubs, golf balls, and/or hands. Such an item is usually carried in a golf bag or attached thereto.

What is needed, therefore, is an umbrella that has utility other than protecting from sun or rain, providing an additional function that makes it more likely that an individual, such as a golfer, would carry the device even when it is not raining. What is further needed is an umbrella that performs a useful function when in its collapsed position.

What is further needed is a device that combines the functionality of a collapsible umbrella and a towel, thus obviating the need to carry both. What is further needed is a device that combines such functionality with additional functionality, for example to be usable as a removable, washable, water-resistant mat. What is further needed is a combination collapsible umbrella and a towel that is adapted to the needs of a golfer.

SUMMARY OF THE INVENTION

In various embodiments, the present invention is a collapsible umbrella that can be used as a towel when in its collapsed position.

In a collapsed position, the umbrella of the present invention can be used as a towel, to clean, wipe, and or dry objects, hands, faces, and the like. In an open position, the umbrella function is enabled, so as to protect a person or objects from rain and/or sun.

In one embodiment, the canopy of the umbrella is constructed from material having two surfaces performing different functions. This can be accomplished by bonding two materials together, or by the use of a single material having two opposing surfaces with distinct properties.

For example, one surface of the canopy can be constructed from a waterproof (or water-resistant) material such as nylon, plastic, vinyl, or the like; this first surface forms a top surface of the umbrella canopy when the umbrella is open, to act as a waterproof barrier to keep rain out. The opposite surface can be constructed from an absorbent material such as cotton, terrycloth, or the like, to be used as a towel when the device is in a collapsed position. This second surface forms the underside of the umbrella canopy when the umbrella is open, but is exposed and available for use when the umbrella is collapsed.

In one embodiment, the umbrella of the present invention contains a mechanism adapted to collapse the umbrella in a manner that turns the canopy inside out when in the collapsed position, so as to hide the water-resistant surface of the canopy and expose the absorbent surface. The absorbent surface then becomes naturally accessible for use when the umbrella is in the collapsed position. Conversely, when the umbrella is opened, the absorbent surface is protected from rain because it is underneath the water-resistant surface. In this manner, the absorbent surface stays dry even when the umbrella is used in the rain, making that surface available for subsequent use as a towel.

Additional embodiments, variations, and advantages will become apparent in the discussion below.

BRIEF DESCRIPTION OF THE DRAWINGS

The accompanying drawings illustrate several embodiments of the invention and, together with the description, serve to explain the principles of the invention.

One skilled in the art will recognize that the described and illustrated embodiments are merely exemplary, and that many other embodiments can be constructed without departing from the essential characteristics of the present invention as recited in the claims.

DETAILED DESCRIPTION OF THE EMBODIMENTS

The present invention is now described more fully with reference to the accompanying Figures, in which several embodiments of the invention are shown. The present invention may be embodied in many different forms and should not be construed as limited to the embodiments set forth herein. Rather these embodiments are provided so that this disclosure will be complete and will fully convey the invention to those skilled in the art.

In the following description, the invention is set forth in the context of a collapsible golf-club umbrella that can be used as a towel when in its collapsed position. However, one skilled in the art will recognize that the invention can be implemented in other ways as well. For example the umbrella of the present invention can be implemented at any desired size, so as to have uses other than for golf clubs. More specifically, a larger-sized embodiment may be used as a personal umbrella. It will be apparent from the description provided herein that many other variations are possible, and that the particular embodiments set forth herein are intended to be exemplary and not limiting.

Figure 1:
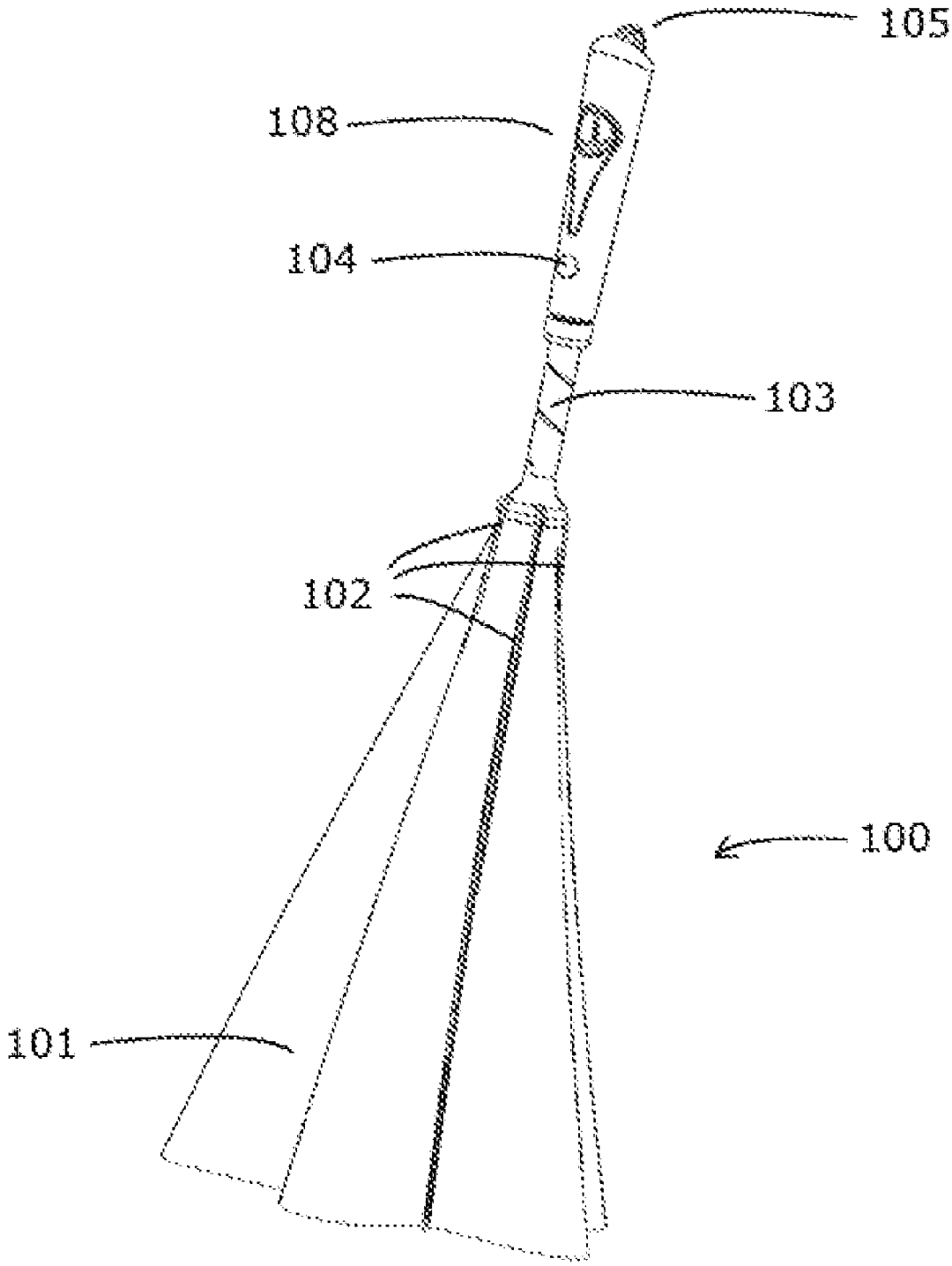
FIG. 1 depicts an umbrella according to one embodiment of the present invention, in its collapsed position.
Figure 2:
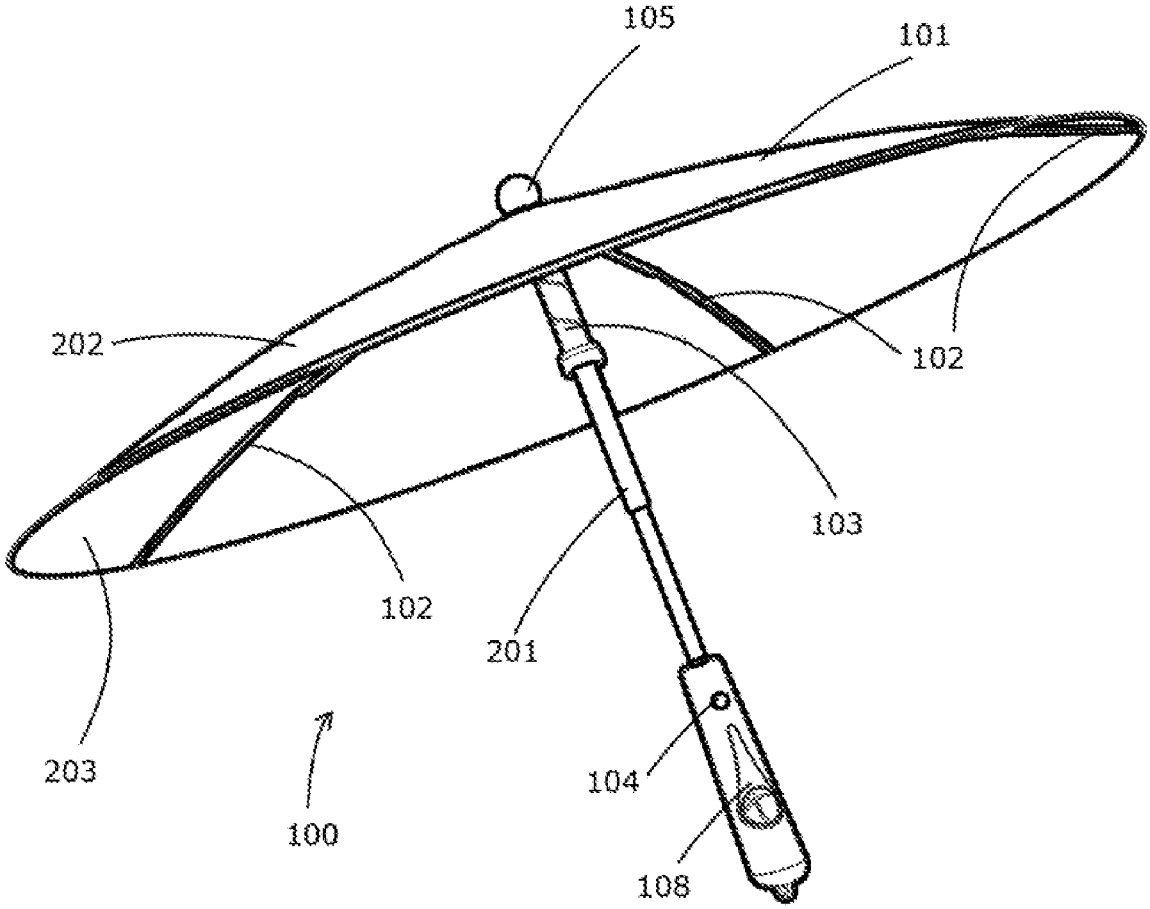
FIG. 2 depicts an umbrella according to one embodiment of the present invention, in its open position.

Referring now to FIGS. 1 and 2, there is shown an umbrella 100 according to one embodiment of the present invention. In FIG. 1, umbrella 100 is shown in a collapsed position; in FIG. 2, it is shown in an open position.

Umbrella 100 includes handle 108, by which the user can hold umbrella 100 when in its open or collapsed position. In one embodiment, button 104 allows a user to switch between open and collapsed positions, as described in more detail below. In one embodiment, a sliding grip 103 extends from handle 108 when umbrella 100 is in its collapsed position, to allow easier access for towel functionality.

In one embodiment, canopy 101 has two surfaces: a waterproof or water-resistant surface 202 that provides protection from rain when umbrella 100 is in its open position, and an absorbent surface 203 that is usable as a towel when umbrella 100 is in its collapsed position. The mechanism of umbrella 100, as described in more detail below, exposes absorbent surface 203 when umbrella 100 is in its collapsed position, as shown in FIG. 1. When umbrella 100 is in the open position, as shown in FIG. 2, water-resistant surface 202 is on top and absorbent surface 203 is underneath, so that absorbent surface 203 is protected from getting wet or dirty.

For example, absorbent surface 203 of canopy 101 can be constructed from terrycloth, cotton, or the like. Water-resistant surface 202 can be constructed from plastic, nylon, or the like. The two surfaces 202, 203 can be attached, sewn, glued, or bonded to one another; alternatively, a single material can be used having two distinct surfaces 202, 203.

Support arms 102, or spokes, are provided, to support canopy 101 when in the open position. Support arms 102 can be located either above or below canopy 101, and affixed thereto to provide proper support. Depending on their positions, support arms 102 can be exposed when umbrella 100 is in the collapsed position and/or in the open position. Alternatively, support arms 102 can run through the material of canopy 101, such as between layers or through sleeves (not shown) in the material of canopy 101, so that support arms 102 are hidden from view in either position. In the example, five support arms 102 are depicted, although in other embodiments the invention can be implemented using any number of support arms 102.

Support arms 102 are attached to sliding grip 103. In the open position, as shown in FIG. 2, shaft 201 connects handle 108 with sliding grip 103. In one embodiment, shaft 201 can be extended or collapsed, for example via a telescoping arrangement, to be hidden within handle 108 when umbrella 100 is in its collapsed position.

In one embodiment, umbrella 100 includes a loop 105 for allowing umbrella 100 to hang when in its collapsed position. Loop 105 can be attached to a golf bag, stroller, backpack, hook or other object, so as to make umbrella 100 more accessible for use as a towel when in its collapsed position. One skilled in the art will recognize that a hook, strap, or other similar mechanism can be used in place of loop 105.

Figure 3:
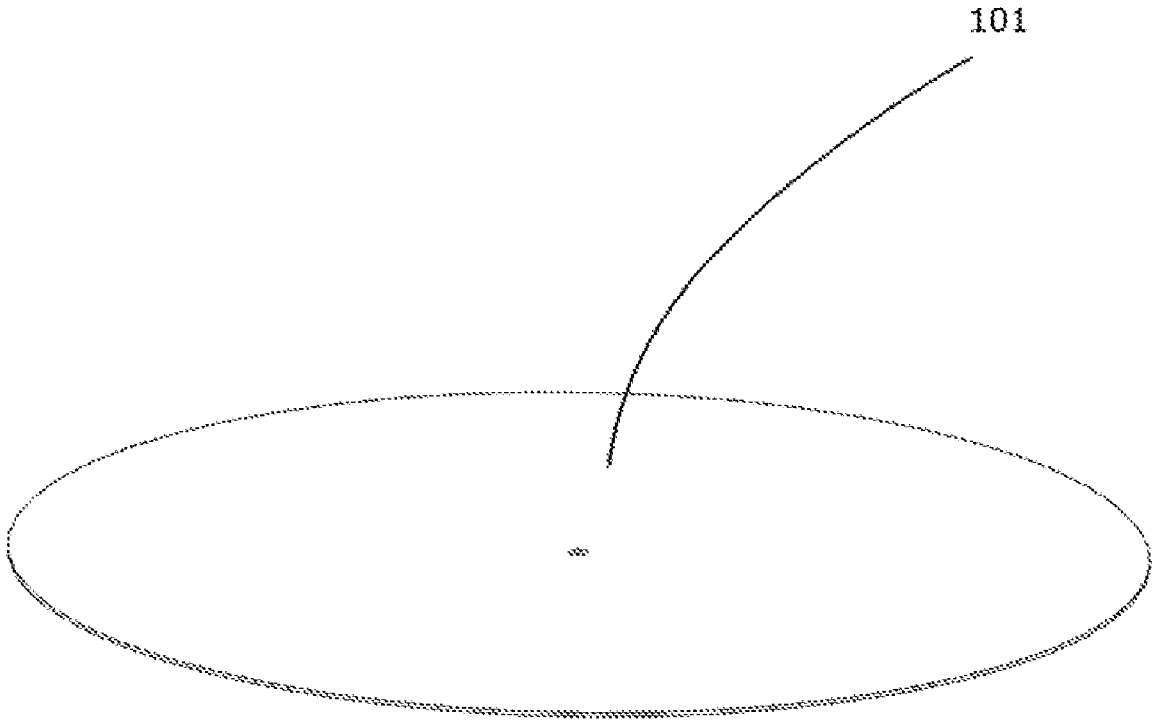
FIG. 3 depicts a third use of an umbrella according to one embodiment wherein the canopy of the umbrella has been removed to function as a mat.

Referring now to FIG. 3, there is shown a third function of the umbrella of the present invention. Canopy 101 can be removed from the assembly shown in FIGS. 1 and 2, and used as a mat. In this mode of operation, canopy 101 can be placed on the ground, on a table, or on any other surface. Canopy 101 can be placed so that its water-resistant surface is underneath the absorbent surface, so as to provide protection from the ground or other surface on which canopy 101 is placed, for example if the ground is moist or dirty.

As described in more detail below, in one embodiment, canopy 101 can be removed from the assembly for cleaning, or to be replaced with another color or style, or for any other reason. In one embodiment, canopy 101 is made from a washable material.

Figure 4:
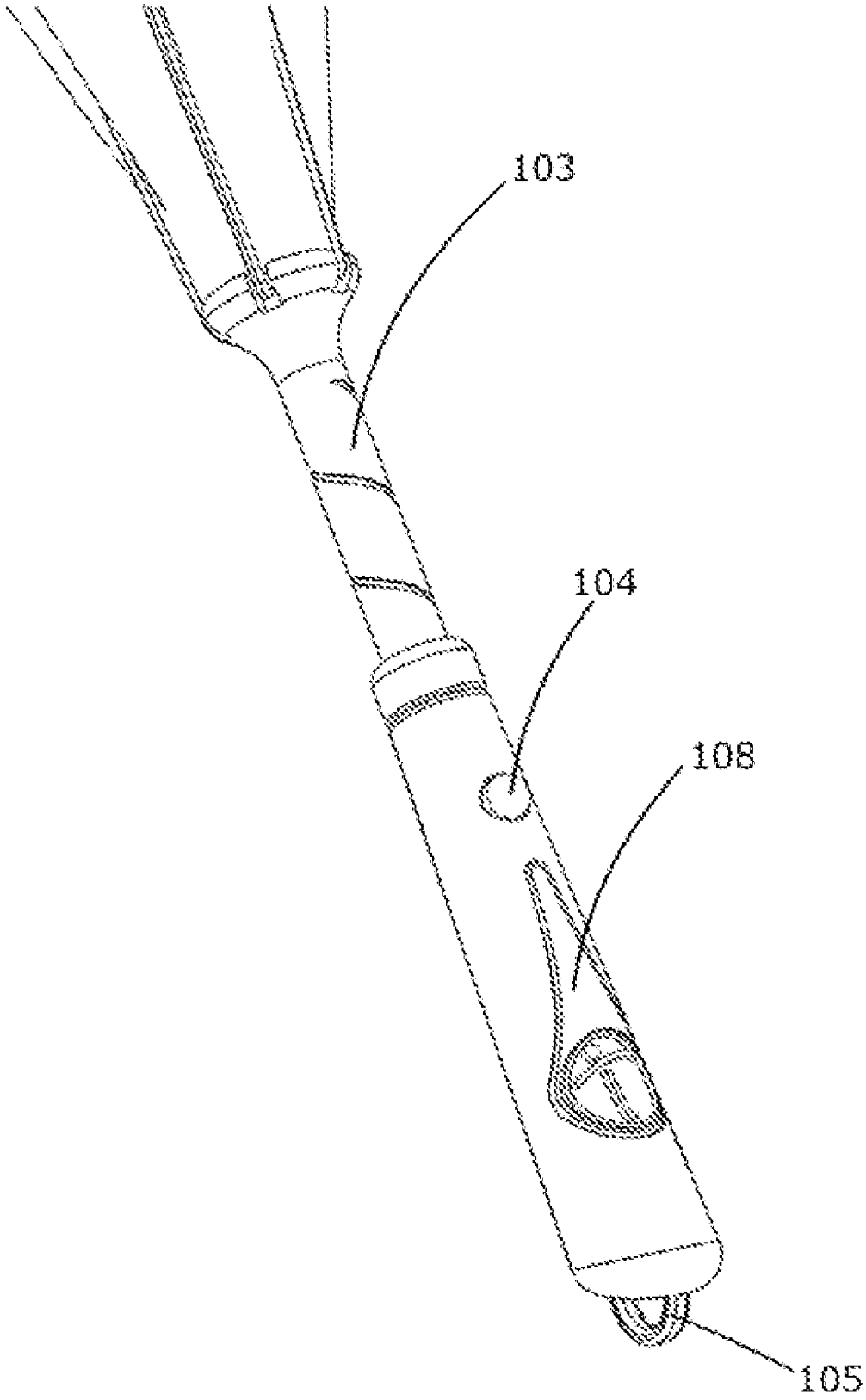
FIG. 4 is a detail view of a handle of an umbrella according to one embodiment.

Referring now to FIG. 4, there is shown a detail view of handle 108 for umbrella 100 according to one embodiment, including sliding grip 103, button 104, and loop 105 as described above.

Figure 5A:
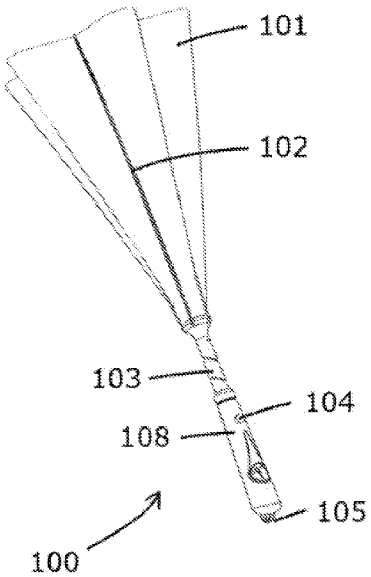
FIGS. 5A and 5B depict an example of a transition from a collapsed position to an open position for an umbrella according to one embodiment.
Figure 5B:
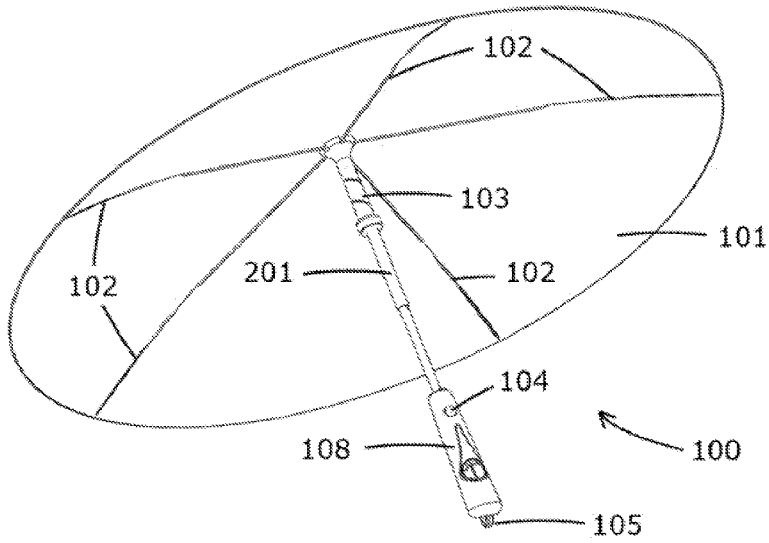

Referring now to FIGS. 5A and 5B, there is shown an example of a transition from a collapsed position to an open position for umbrella 100 according to one embodiment. To transform umbrella 100 from a collapsed position to an open position, the user pushes button 104. In one embodiment, an internal spring mechanism (not shown in FIGS. 5A and 5B) causes shaft 201 to extend from handle 108 and causes support arms 102 to fold out according to well known techniques for umbrellas. Canopy 101 is thereby supported in an open position, providing protection from sun and rain.

In one embodiment, to transform umbrella 100 from the open position back to the collapsed position, the user holds down button 104 while pulling sliding grip 103 down towards handle 108. Shaft 201 retracts, and support arms 102 fold up automatically. Sliding grip 103 clicks into place by a latch, magnet, or other mechanism (not shown) to engage with handle 108.

Figure 6:
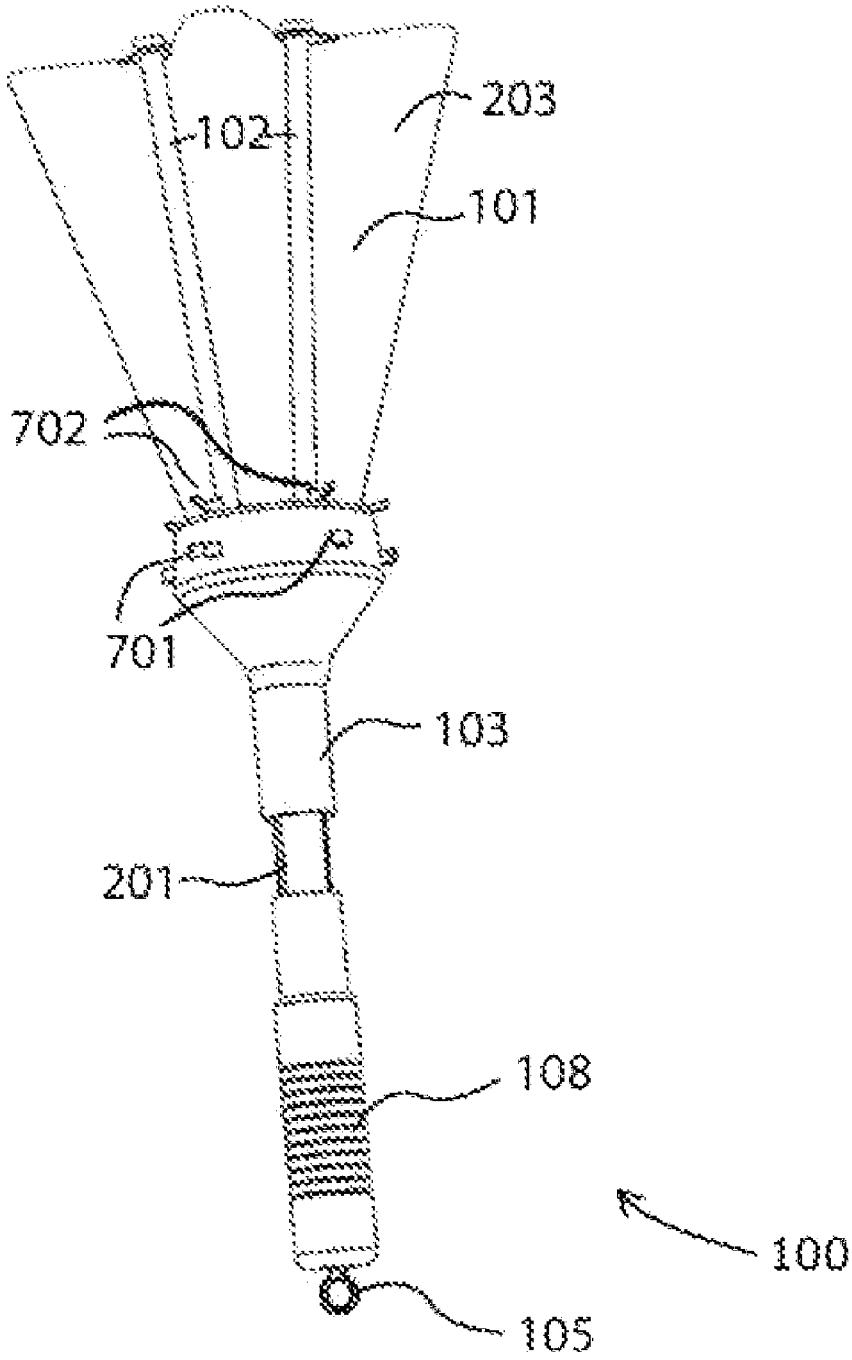
FIG. 6 depicts an umbrella according to one embodiment of the present invention, in its collapsed position.
Figure 7:
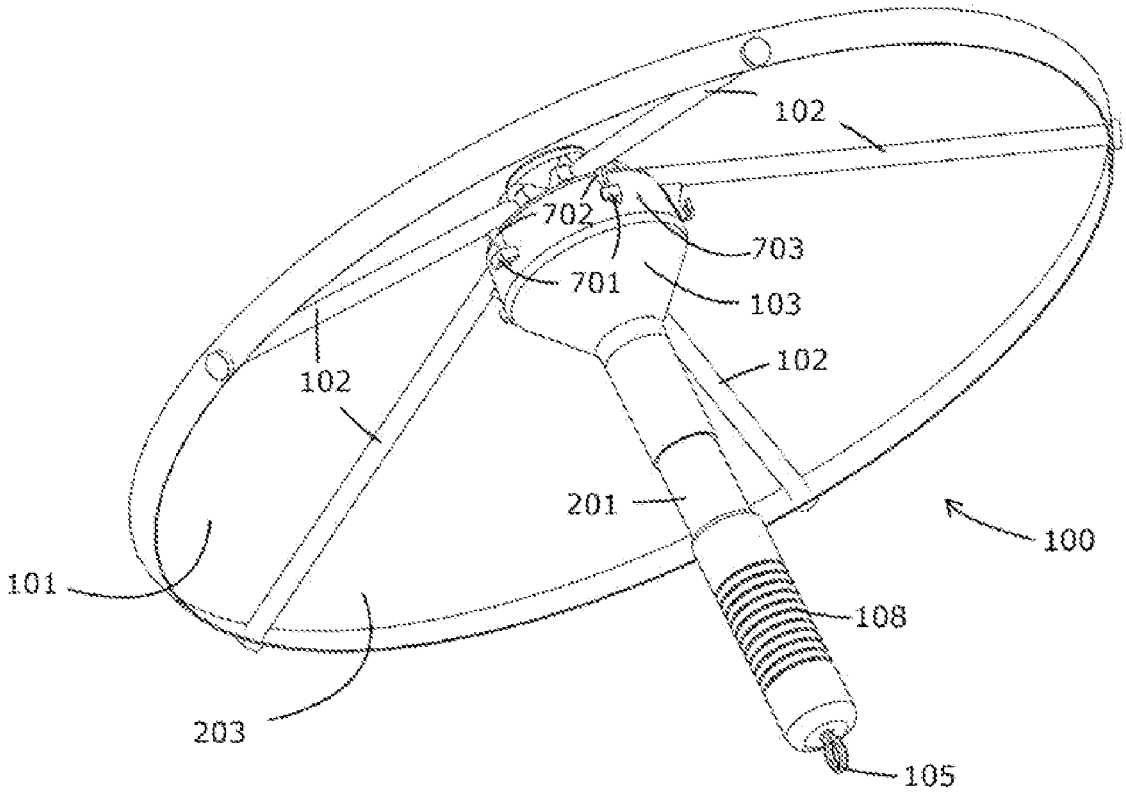
FIG. 7 depicts an umbrella according to one embodiment of the present invention, in its open position.

Referring now to FIGS. 6 and 7, there is shown another embodiment of umbrella 100 in a collapsed position and in an open position, respectively. In this embodiment, the user changes the position of umbrella 100 by rotating and moving sliding grip 103 along shaft 201, as described below. Thus, button 104 can be omitted.

In FIG. 6, umbrella 100 is shown in its collapsed position, with absorbent surface 203 exposed for use as a towel, as described above. In FIG. 7, umbrella 100 is shown in its open position, with absorbent surface 203 as the underside of canopy 101.

Sliding grip 103 includes a collar section 703. In one embodiment, a set of slider hooks 701 is positioned around the outer surface of collar section 703.

When umbrella 100 is in the collapsed position, as shown in FIG. 6, collar section 703 supports nubs 702 that are attached to arms 102, so as to hold arms 102 in position.

When umbrella 100 is in the open position, as shown in FIG. 7, slider hooks 701 engage with nubs 702 to hold support arms 102 in place.

Figure 8A:
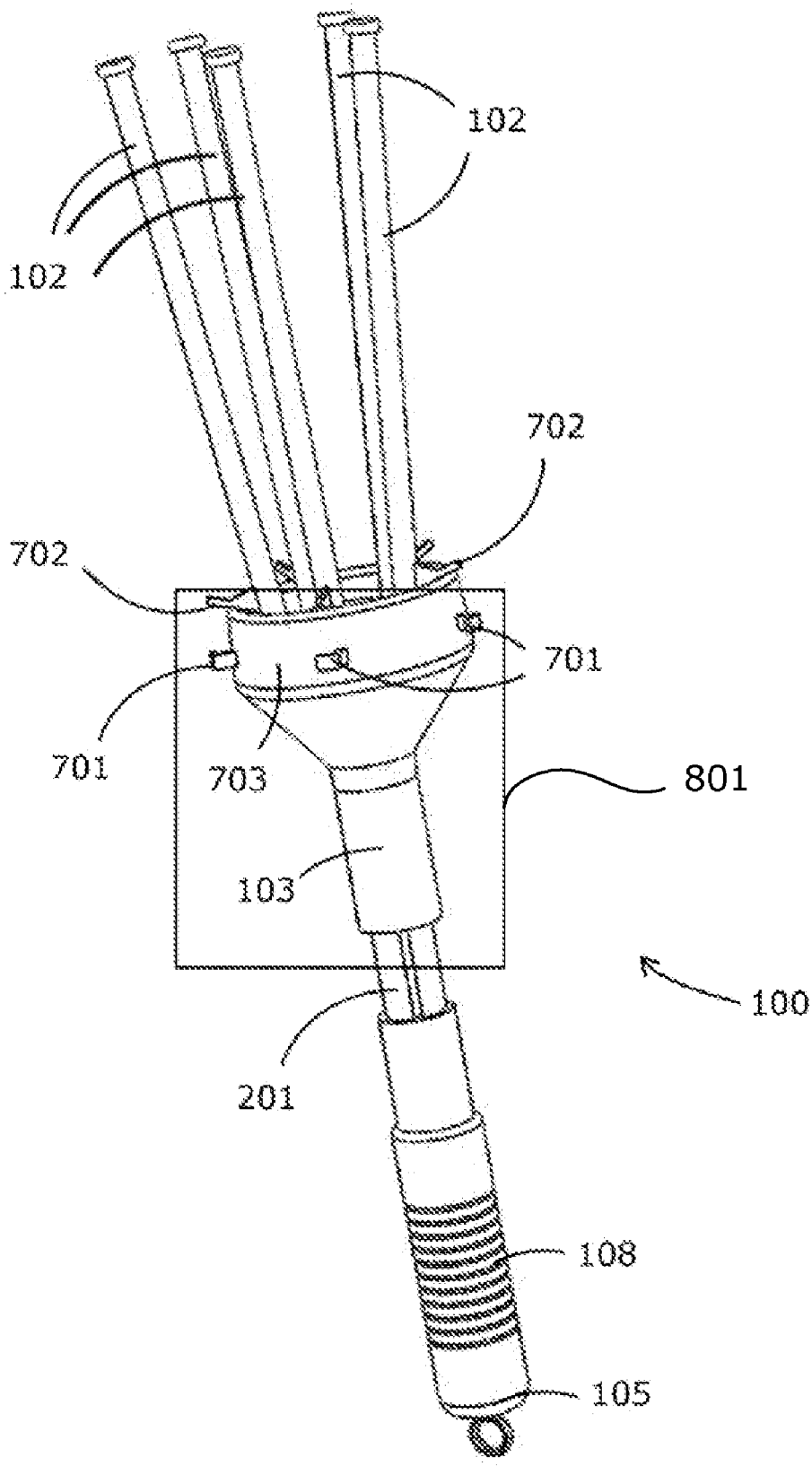
FIGS. 8A and 8B depict a cutaway view of an umbrella according to one embodiment of the present invention, showing a detail of a mechanism for locking the umbrella in a collapsed position.
Figure 9A:
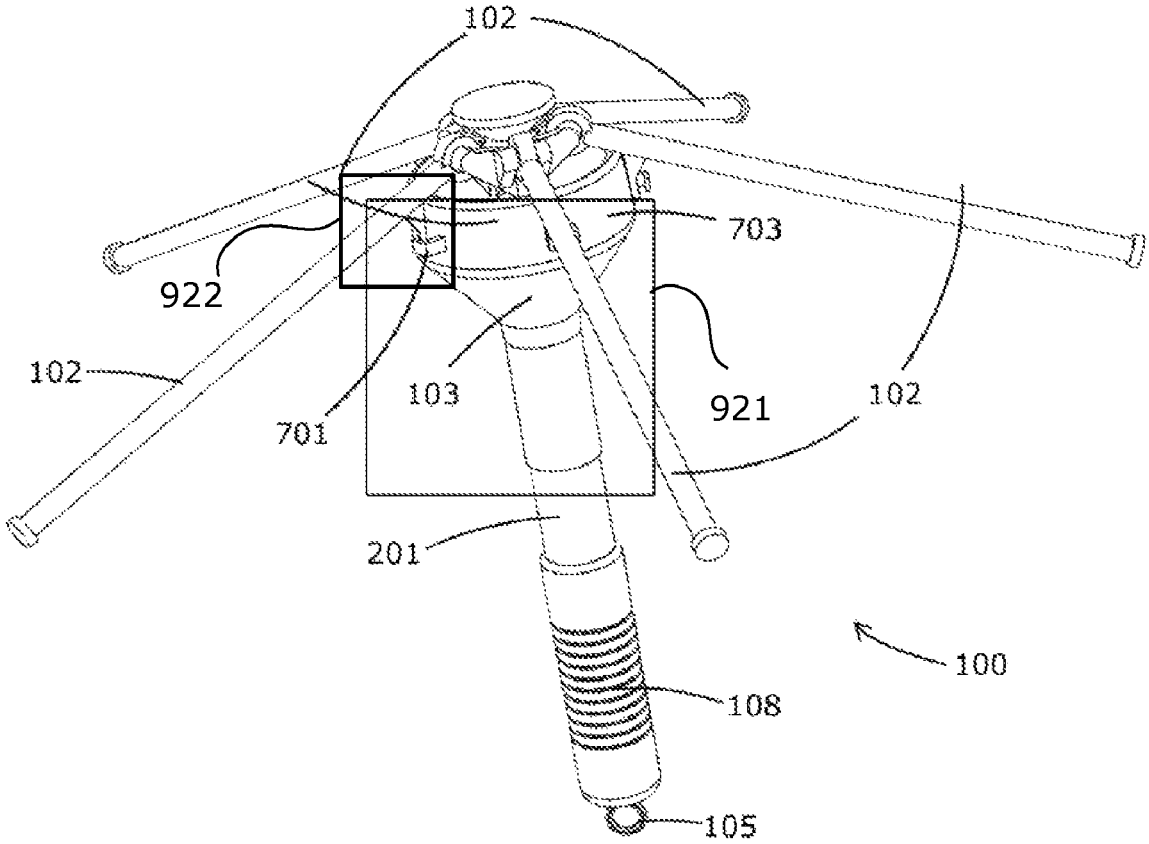
FIGS. 9A through 9C depict a cutaway view of an umbrella according to one embodiment of the present invention, showing operation of slider hooks to constrain arms when in an open position.
Figure 9B:
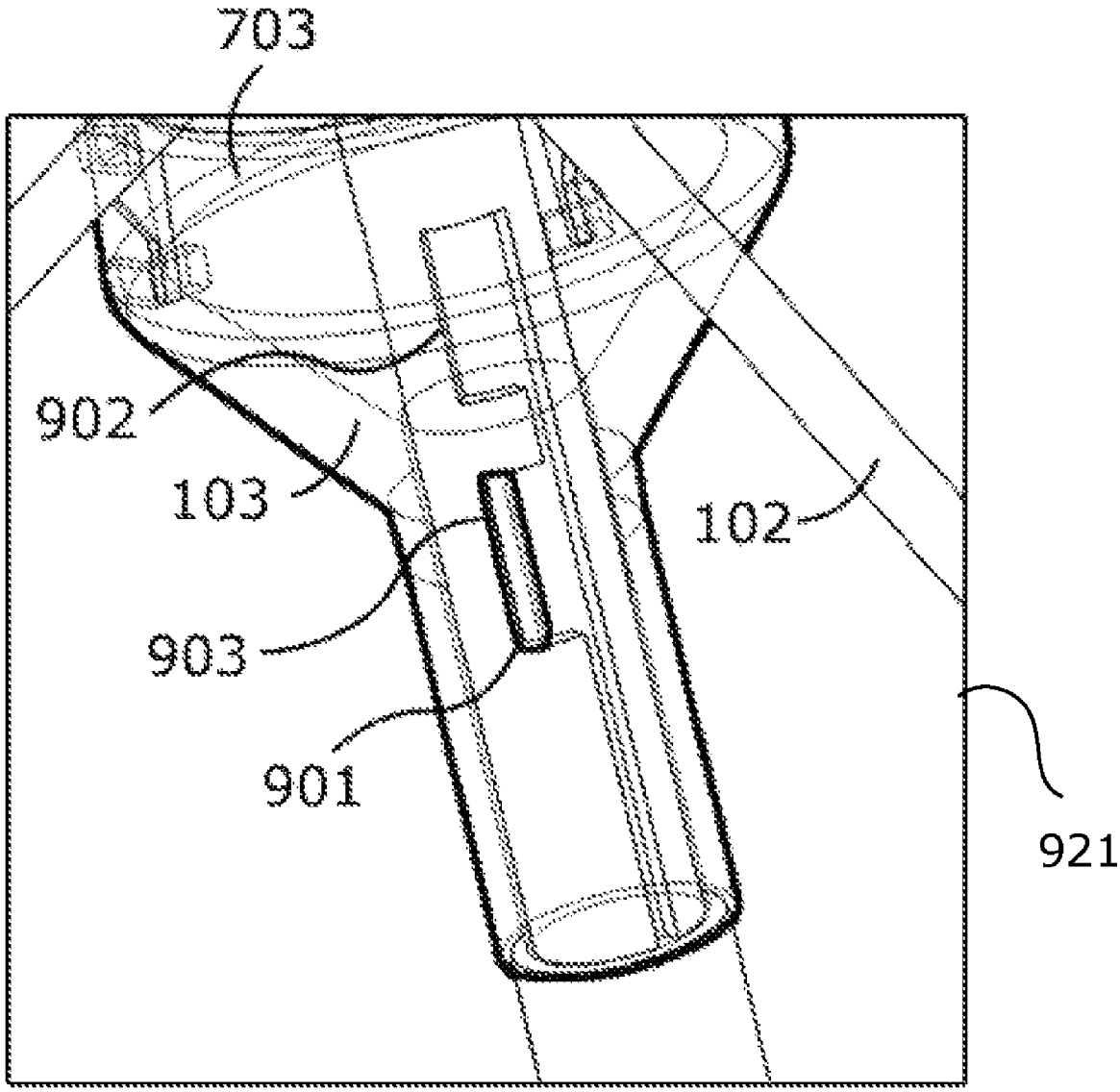
Figure 9C:
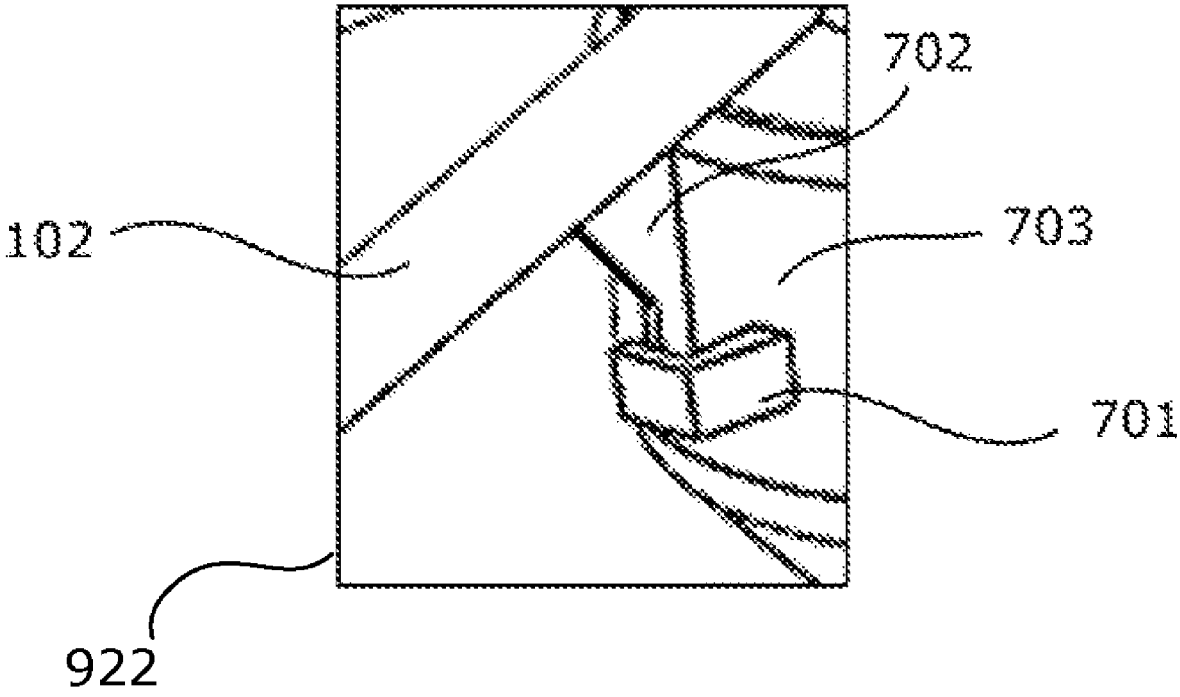

FIGS. 8A, 9A and 9C show this mechanism in more detail by depicting umbrella 100 with canopy 101 omitted. In FIG.

8A, collar section 703 supports nubs 702, holding arms 102 in the collapsed position. In FIGS. 9A and 9C, slider hooks 701 are engaged with nubs 702 to support arms 102 in the open position. FIG. 9C depicts area 922 of FIG. 9A in greater detail.

Figure 8B:
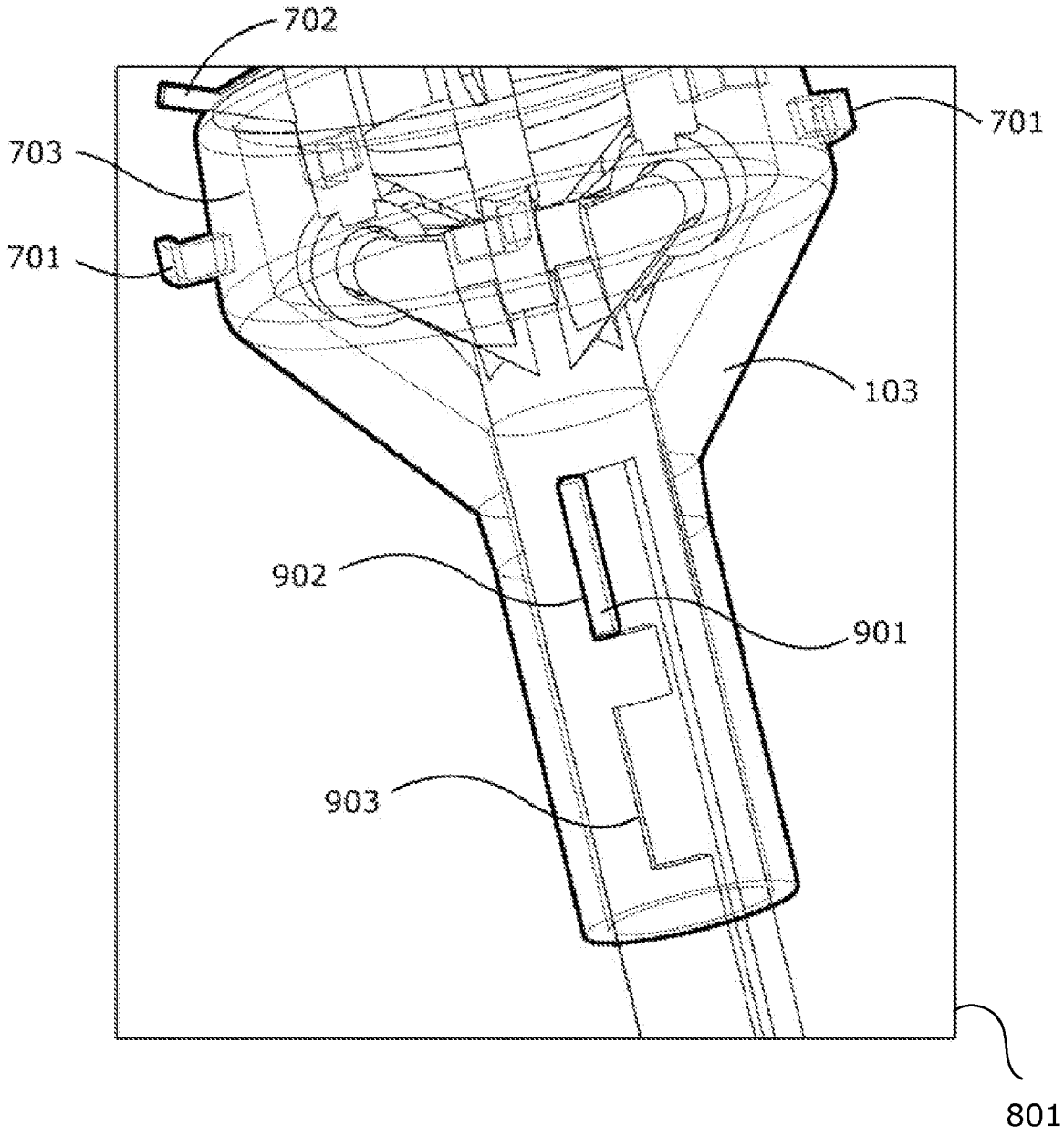

In one embodiment, sliding grip 103 is held in place in one of the two positions by an internal mechanism as depicted in cutaway form in FIGS. 8B and 9B. FIG. 8B depicts area 801 of FIG. 8A in cutaway form, wherein umbrella is in a collapsed position. FIG. 9B depicts area 921 of FIG. 9A in cutaway form, wherein umbrella is in an open position. For illustrative purposes, canopy 101 is omitted from these Figures.

Sliding grip 103 includes an internal protrusion 901, not normally visible to the user, that engages with one of two interior ledges 902, 903 in shaft 201. Ledge 902 holds sliding grip 103 so as to maintain the collapsed position of umbrella 100, while ledge 903 holds sliding grip 103 so as to maintain the open position of umbrella 100.

The user can disengage internal protrusion 901 from one of ledges 902, 903 by rotating sliding grip 103 by some amount, such as for example 45 degrees. Sliding grip 103 can then be moved along shaft 201 to switch from open position to collapsed position or vice versa. Once sliding grip 103 is in its desired position, user can then rotate sliding grip 103 back, so as to re-engage internal protrusion 901 with one of ledges 902, 903. In one embodiment, an internal spring mechanism can be providing to automatically re-engage protrusion 901 when the user releases sliding grip 103.

In one embodiment, when the user lowers sliding grip 103 from its upper position (where protrusion 901 engages with ledge 902) to its lower position (where protrusion 901 engages with ledge 903), the downward movement of collar 703 causes support arms 102 to rotate downwards by some amount, such as for example 100 degrees, thereby exposing the water-resistant surface of canopy 101 and allowing the device to function as an umbrella. Conversely, when the user raises sliding grip 103 from its lower position (where protrusion 901 engages with ledge 903) to its upper position (where protrusion 901 engages with ledge 902), the upward movement of collar 703 causes support arms 102 to rotate upwards by some amount, such as for example 100 degrees, thereby exposing the absorbent surface of canopy 101 and allowing the device to function as a towel.

In one embodiment, the rotational movement that causes protrusion 901 of sliding grip 103 to disengage from ledge 903 when umbrella 100 is in its open position simultaneously causes nubs 702 to disengage from slider hooks 701. Similarly, the rotational movement that causes protrusion 901 of sliding grip 103 to re-engage from ledge 903 when umbrella is locked into its open position simultaneously causes nubs 702 to re-engage with slider hooks 701. In this manner, the operation of switching between modes is simplified, as only one motion is needed to perform both functions of engaging (or disengaging) protrusion 901 and nubs 702. In one embodiment, the optional internal spring mechanism mentioned above keeps slider hooks 701 engaged with nubs 702.

To summarize, then, the user can cause umbrella 100 to switch from one position to another by rotating sliding grip 103 counter-clockwise, moving grip 103 along shaft to the desired position, and rotating sliding grip 103 clockwise to lock it into place.

One skilled in the art will recognize that the mechanisms shown in FIGS. 8A, 8B, and 9A through 9C are merely exemplary, and that other mechanisms for holding support arms 102 and for extending shaft 201 can be used. Umbrella 100 can be adapted to extend shaft 201, for example to provide different heights in the open position.

Figure 10A:
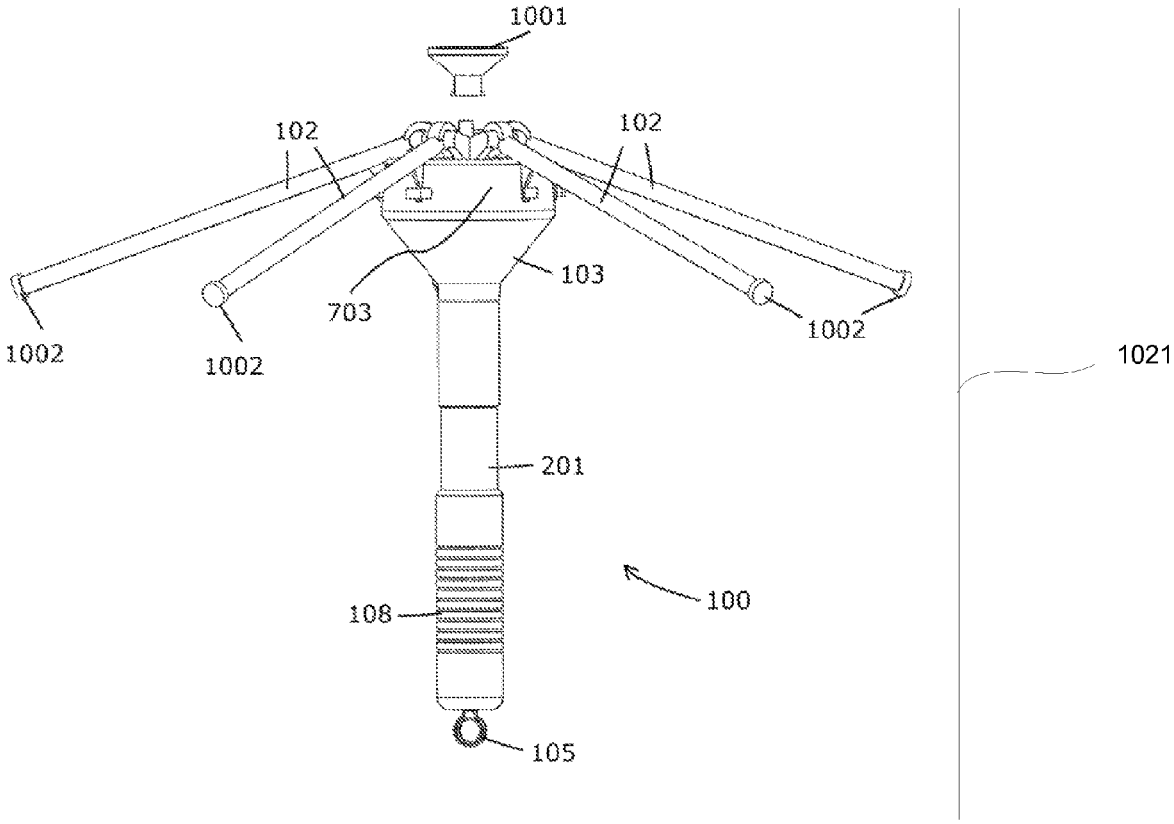
FIGS. 10A and 10B depict a mechanism by which the canopy of the umbrella is fastened to the body of the umbrella according to one embodiment of the present invention.
Figure 10B:
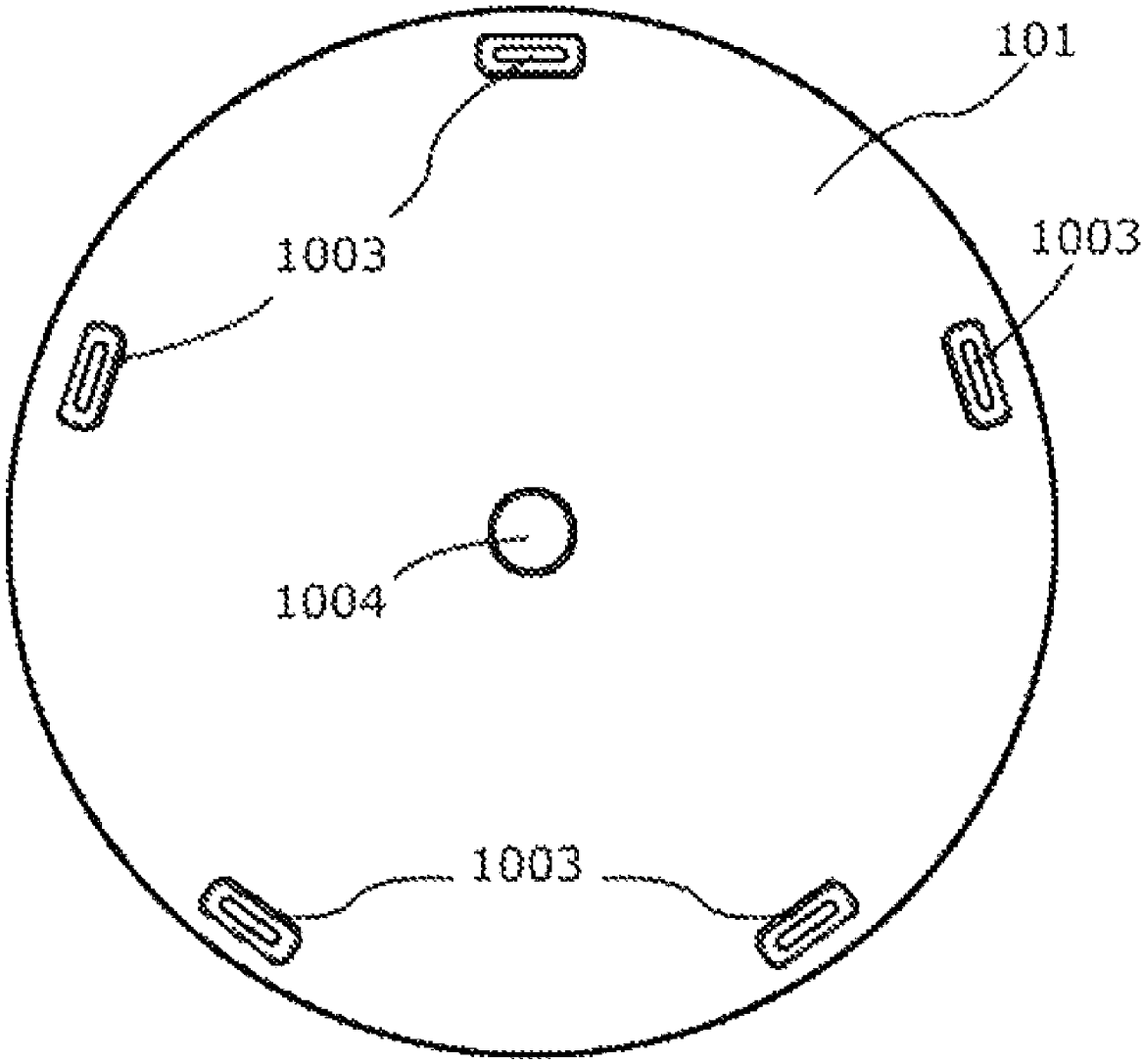

Referring now to FIGS. 10A and 10B, there is shown an example of a mechanism by which canopy 101 is fastened to support arms 102 of umbrella 100 according to one embodiment. As depicted in exploded view 1021, canopy 101 includes a number of button ledges 1003, adapted to engage with buttons 1002 located at the ends of support arms 102. In this manner, canopy 1003 is held in place to be supported by arms 102 in either the collapsed or open position of umbrella 100.

In one embodiment, canopy 101 is further held in place by center pin 1001, which passes through hole 1004 in canopy 101 and attaches to upper grip 103. Center pin 1001 can be fastened by a snap fastener, or by a screw-type threaded connector, or by any other means. To fasten canopy 101, center pin 1001 is temporarily removed from upper grip 103, buttons 1002 are inserted in button ledges 1003, and center pin 1001 is pushed through hole 1004 to re-engage with upper grip 103. To remove canopy 101, center pin 1001 is temporarily removed from upper grip 103, buttons 1002 are detached from button ledges 1003, and canopy 101 is lifted off of support arms 102; center pin 1001 can then be reattached to upper grip 103. In this manner, canopy 101 is easily removable for cleaning, or for use as a mat, or to be replaced with a different style or color of canopy 101, for any other reason.

In one embodiment, umbrella 100 of the present invention and its components are constructed from plastic, wood, metal, or any combination thereof. In one embodiment, canopy 101 is constructed from plastic, nylon, terrycloth, cotton, polyester, or any combination thereof, and may further be adapted to have two surfaces to perform the various functions described above.

In the above description, for purposes of explanation, numerous specific details are set forth in order to provide a thorough understanding of the invention. It will be apparent, however, to one skilled in the art that the invention can be practiced without these specific details. In other instances, structures and devices are shown in block diagram form in order to avoid obscuring the invention.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment.

As will be understood by those familiar with the art, the invention may be embodied in other specific forms without departing from the spirit or essential characteristics thereof. For example, the particular architectures depicted above are merely exemplary of one implementation of the present invention. Other mechanisms for extending, collapsing, and/or locking the umbrella can be used.

The functional elements and method steps described above are provided as illustrative examples of one technique for implementing the invention; one skilled in the art will recognize that many other implementations are possible without departing from the present invention as recited in the claims. Likewise, the particular capitalization or naming of the modules, protocols, features, attributes, or any other aspect is not mandatory or significant, and the mechanisms that implement the invention or its features may have different names or formats. In addition, the present invention may be implemented as a method, process, user interface, computer program product, system, apparatus, or any combination thereof.

Accordingly, the disclosure of the present invention is intended to be illustrative, but not limiting, of the scope of the invention, which is set forth in the following claims.

What is claimed is:

1. A collapsible umbrella comprising:

a handle;

a shaft, coupled to the handle;

a collapsible canopy, coupled to the shaft, the canopy comprising:

a first surface constructed from water-resistant material; and a second surface, opposing the first surface, constructed from water-absorbent material;

the canopy adapted to have an open position in which the first surface is oriented upward to perform a protective function and the second surface is oriented underneath the first surface, and an inside-out collapsed position in which the second surface is returned outward to be accessible for an auxiliary use as a towel.

2. The umbrella of claim 1, further comprising a plurality of collapsible support arms, wherein, in the open position, the canopy is supported by the support arms.

3. The device of claim 1, wherein, in the open position, the canopy is adapted to protect against rain.

4. The umbrella of claim 1, wherein the surfaces of the canopy are attached to one another.

5. The umbrella of claim 1, wherein the first surface is constructed from at least one selected from the group consisting of:

nylon; and plastic.

6. The umbrella of claim 1, wherein the second surface is constructed from at least one selected from the group consisting of:

cotton; and terrycloth.

7. The umbrella of claim 1, wherein the shaft is extendable.

8. The umbrella of claim 1, further comprising a locking mechanism for maintaining the canopy in at least one of the open and collapsed positions.

9. The umbrella of claim 1, wherein the canopy is removable from the shaft.

10. The umbrella of claim 9, wherein the canopy is adapted to be usable as a mat when removed from the shaft.

11. A method for using an umbrella for an auxiliary use, comprising:

opening an umbrella to perform a protective function, the umbrella comprising a canopy having:

a first surface constructed from water-resistant material; and a second surface, opposing the first surface, constructed from water-absorbent material;

holding the umbrella in the open position, wherein the first surface is oriented upward, the second surface is oriented underneath the first surface;

collapsing the canopy in an inside-out manner to reversibly turn the second surface outward to be accessible for an auxiliary use; and using the second surface for an auxiliary use as a towel.

12. The method of claim 11, wherein collapsing the canopy comprises collapsing a plurality of support arms that support the canopy.

13. The method of claim 11, wherein using the umbrella to perform a protective function comprises using the umbrella to protect against rain.

14. The method of claim 11, further comprising:

prior to collapsing the canopy, unlocking a locking mechanism for maintaining the canopy in at least one of an open and collapsed positions; and after collapsing the canopy, locking the locking mechanism.

15. The method of claim 11, further comprising removing the canopy for use as a mat.

16. A method for using an umbrella for an auxiliary use, comprising:

holding an umbrella having a canopy being in an inside-out collapsed position, using a first outword accessible surface of the canopy of the umbrella for an auxiliary use as a towel;

opening the canopy reversibly to turn the first surface of the canopy oriented downward, and to make a second surface of the canopy oriented upward for a protective function; and using the umbrella to perform the protective function;

wherein:

the first surface is constructed from water-absorbent material; and the second surface is opposing the first surface and constructed from water-resistant material.

* * * * *